United States Patent [19]

Jacks et al.

[11] Patent Number: 5,035,181

[45] Date of Patent: Jul. 30, 1991

[54] THERMOSENSITIVE POP-OUT DEVICE

[75] Inventors: Donald J. Jacks; Clayton E. Panlaqui; Raymond E. Boss, all of Ridgecrest, Calif.; Edwin Gaunt, Inyokern, Calif.

[73] Assignee: The United States of America as represented by the Secretary of the Navy, Washington, D.C.

[21] Appl. No.: 693,633

[22] Filed: Jan. 22, 1985

[51] Int. Cl.[5] ..... F42B 39/00

[52] U.S. Cl. ..... 102/481; 102/293; 220/89.4

[58] Field of Search ..... 102/481, 293; 220/89 B, 220/89 A, 367, DIG. 27, 89.1, 89.2, 89.4; 86/1 A, 50; 285/1; 137/72; 169/42

[56] References Cited

U.S. PATENT DOCUMENTS

| | | | |
|---|---|---|---|
| 2,035,497 | 3/1936 | Morse | 220/89 B |
| 2,293,366 | 8/1942 | Solosko | 220/89 B |
| 2,318,005 | 5/1943 | McGuinness | 220/89 B |
| 2,500,119 | 3/1950 | Cooper | 220/89 B |
| 2,911,988 | 11/1959 | Ravn | 220/89 B |
| 3,665,857 | 5/1972 | Radnich et al. | 102/1 R |
| 3,972,289 | 8/1976 | Morris | 102/70 R |
| 4,004,516 | 1/1977 | Johnson et al. | 102/24 R |
| 4,022,130 | 5/1977 | Johnson et al. | 102/56 R |
| 4,411,199 | 10/1983 | Yates et al. | 102/481 |

FOREIGN PATENT DOCUMENTS

| | | | |
|---|---|---|---|
| 2116682 | 9/1983 | United Kingdom | 102/489 |

*Primary Examiner*—Harold J. Tudor

*Attorney, Agent, or Firm*—Stephen J. Church; Melvin J. Sliwka; Sol Sheinbein

[57] ABSTRACT

A device mounting a fuze in the casing of an ordanance item and providing for pop-out of the fuze to reduce cook-off hazard when the casing is heated. The device has an outer sleeve fixed to the casing, an inner sleeve slideably mounted in the outer sleeve and receiving the fuze, and a resilient element urging the inner sleeve and the fuze from the casing. The sleeves are retained together at normal temperature by a layer therebetween of material which melts at a higher temperature to release the inner sleeve and fuze.

6 Claims, 1 Drawing Sheet

THERMOSENSITIVE POP-OUT DEVICE

BACKGROUND OF THE INVENTION

1. Field of the Invention

This invention pertains to the field of receptacles. More particularly, the invention pertains to fusible receptacle attachments for explosion control.

2. Description of the Prior Art

Ordnance items present an extreme hazard in the event of "cook-off," which is defined for purposes of the subject application as detonation or deflagration of the main explosive charge of the item due to an accidental fire. The booster charge of a fuze presents such a hazard, and it is known to provide a fuze mounting attachment resiliently urged from an ordnance item for expulsion of the attachment and a fuze mounted thereon from the item. The attachment is normally retained by a material which is weakened by heat from an accidental fire to release the attachment. A booster charge in the fuze is thereby prevented from initiating detonation or deflagration of a main charge of the item, and the main charge is thereby vented so that it burns with relatively little effect instead of detonating or deflagrating. It is highly desirable that such an attachment be adapted for use with existing fuzes and ordnance items, and it is essential that such an attachment not interfere with proper operation of an ordnance item deployed for effect.

A typical fuze is cylindrical and is received in a tubular wall, and the prior art has included annular elements of heat softened material, such as nylon, arranged between the fuze and the wall to retain the fuze therein at normal temperature against the urging of a spring. A unitary such prior art element having a pair of screw threads individually engaging the fuze and well was deficient in that softening to allow fuze expulsion did not occur consistently in time to prevent cook-off. Other prior art attachments having heat softenable washers functioned effectively to prevent cook-off but, due to the limited space available between existing fuzes and fuze walls, lacked sufficient strength to retain the fuze for proper operation on impact.

SUMMARY OF THE INVENTION

A device for mounting a fuze on an ordnance item and having a pair of slideably engaged, concentric sleeves connected at normal temperature by a layer of thermosensitive material between conforming surfaces individual to the sleeves. The material disconnects the sleeves at a temperature below that of which cook-off of the item occurs due to presence of the fuze. The fuze is mounted on the inner sleeve which is resiliently urged from the casing for expulsion therefrom with the fuze when the sleeves disconnect.

It is an object of the subject invention to provide a pop-out device mounting a fuze in an ordnance item for proper fuze operation on impact or other acceleration and sensitive to the temperature of the item so as to expel the fuze therefrom and prevent cook-off.

Another object is to provide such a device adaptable to existing fuzes and fuze wells.

Further objects are to provide such a device which is fully effective and is simple to manufacture and to install and is low in cost.

BRIEF DESCRIPTION OF THE DRAWING

Other objects, advantages, and novel features of the subject invention will be apparent from the following detailed description when considered in conjunction with the accompanying drawing wherein.

DESCRIPTION OF THE PREFERRED EMBODIMENTS

FIRST EMBODIMENT

Figure 1:
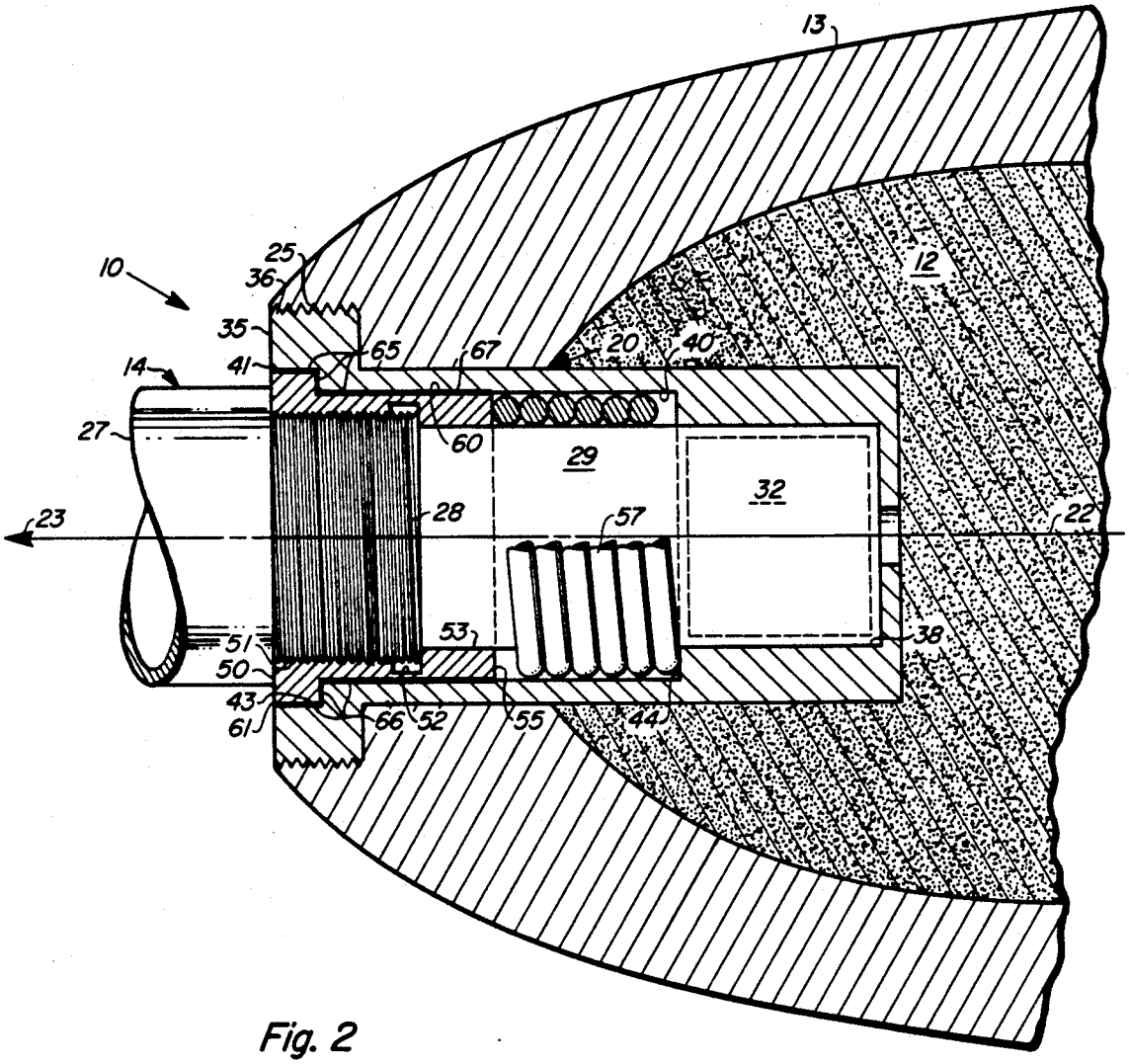
FIG. 1 is an axial section of a first embodiment of the invention in a representative operating environment.

In FIG. 1, a first embodiment of the subject thermosensitive pop-out device is indicated generally by the numeral 10. Device 10 is shown in a representative operating environment of a fragmentarily represented ordnance item having a main explosive charge 12, a casing 13, and a fuze 14 which have a configuration commonly used in an aircraft carried bomb, although it is to be understood that a device embodying the subject invention is utilizable with other ordnance items.

Casing 13 has a circular opening 20 extending through it about an axis 22 having a predetermined direction of movement therealong indicated by arrowhead 23. Opening 20 has a smaller diameter portion disposed toward the interior of casing 13 and has a larger diameter portion circumscribed by female screw threads 25 in the casing. Fuze 14 is generally cylindrical about axis 22 and extends centrally of opening 20. Fuze 14 has a fragmentarily represented portion 27 extending exteriorly of casing 13, has a portion bearing male screw threads 28 aligned transversely of axis 22 with screw threads 25, and has a cylindrical portion 29 somewhat smaller in diameter than screw threads 28 and extending therefrom interiorly of casing 13. Fuze 14 has a booster or booster charge which is represented by dash lines 32 and is disposed in fuze portion 29 remotely from screw threads 28. Charge 12 is thus subject to cook-off detonation if booster 32 detonates due to heat, as from an accidental fire, transferred from casing 13 to fuze 14.

Device 10 has an outer sleeve 35 received in opening 20. Sleeve 35 is configured similarly to a conventional and generally cylindrical fuze well, not shown, used with fuze 14 in that sleeve 35 has an annulus fitted to the enlarged portion of opening 20 and provided peripherally with screw threads 36 which engage screw threads 25 so that these screw threads fixedly connect casing 13 and sleeve 35. Sleeve 35 has a conventional cup-like region which receives the portion of fuze 14 containing booster 32 and which has a cylindrical surface 38 closely and slideably fitted to fuze portion 29, the cup-like region having an opening at axis 22 for communicating a desired detonation of the booster 32 to charge 12.

Sleeve 35 has an inwardly facing cylindrical guiding surface 40 extending from surface 38 to the end of the sleeve opposite surface 38 so that sleeve 35 has an axially open end portion 41. End portion 41 has a counterbore 43 about surface 40. Surface 40 is coaxially related to surface 38 but is somewhat larger in diameter so that sleeve 35 has an annular step 44 connecting surfaces 38 and 40.

Device 10 has a generally cylindrical inner sleeve 50 received within outer sleeve 35 and configured to circumscribe fuze 14 so that the fuze is received centrally in sleeve 50. Sleeves 35 and 50 are thus substantially coaxially aligned along axis 22 with sleeve 35 circumscribing sleeve 50. Sleeve 50 has one open end provided with female screw threads 51 which are adapted to engage fuze screw threads 28 and thus serve to fixedly connect sleeve 50 to fuze 14. Screw threads 51 terminate oppositely of such open end at an annular groove 52. Sleeve 50 has a cylindrical surface 53, which is coaxially related to surface 38 and has substantially the same diameter. Surface 53 extends from groove 52 through an open end of sleeve 50 opposite screw threads 51 so that this sleeve has an annular surface 55 facing step 44. Device 10 has a helical compression spring 57, represented as partially broken away in FIG. 1, extending axially between surfaces 44 and 55 and disposed between surface 40 and fuze portion 29. It is apparent that spring 57, which extends from inner sleeve 50 oppositely of outer sleeve end portion 41, resiliently urges the inner sleeve and fuze 14 to move in a path in direction 23 along axis 22 so as to expel the inner sleeve and the fuze through end portion 41.

Inner sleeve 50 has an outer cylindrical surface 60 which is slideably fitted within the portion of surface 40 which surrounds the inner sleeve, and this sleeve has an annular lip 61 which conforms to and is slideably fitted within counterbore 43. Sleeve 50 is thus slideably related to sleeve 35 for movement therefrom. The peripheral surface of lip 61 and surface 60, taken together, define a first or inner retaining surface 65 borne by and circumscribing sleeve 50. The centrally facing surface of counterbore 43 and the portion of surface 40 surrounding surface 60 taken together define a second or outer retaining surface 66 circumscribed and borne centrally by outer sleeve 35 within end portion 41 thereof. It is evident that retaining surfaces 65 and 66 conform to each other and are juxtapositioned when fuze 14 is fixed to the inner sleeve and is disposed to initiate charge 12. It is also evident that surfaces 65 and 66 are disposed for separation when inner sleeve begins to move along axis 22 in direction 23. Device 10 has a layer 67 extending between surfaces 65 and 66 and represented by a heavy line thereat. It is evident that surface 65 is a surface of revolution disposed exteriorly of sleeve 60 and that surface 66 is disposed centrally of sleeve 35, and it can be seen that surfaces 65 and 66, engaging screw threads 25 and 36, and engaging screw threads 28 and 51 are aligned in a direction transversely of axis 22 and are disposed adjacent to the exterior of casing 13 so as to facilitate heat transfer to layer 67.

Layer 67 is formed from any suitable material which is relatively rigid in the normal range of ambient temperatures, so as to interconnect retaining surfaces 65 and 66 and retain inner sleeve 50 to outer sleeve 35 against the urging of spring 57, and which becomes relatively softened, as by melting, at a predetermined higher temperature so as to disconnect the retaining surfaces and release the inner sleeve from the outer sleeve so that the spring expels the inner sleeve together with a fuze 14 from the outer sleeve. Fuze 14 is thereby carried from charge 12 avoiding cook-off thereof due to detonation initiated by booster 32 and venting the charge through outer sleeve 35 avoiding cook-off due to pressure buildup within casing 13.

Layer 67 is, preferably, formed from soft solder, a well known alloy of tin and lead which is relatively rigid at normal temperatures and which begins to melt at a temperature of about 350° F. or 180° C. The layer is formed by placing sleeves 35 and 50 into their relative positions shown in FIG. 1 and melting soft solder so as to flow between surfaces 65 and 66 which are constructed to provide a suitable radial clearance for the flowable solder, such as a clearance of 0.010 to 0.015 inch (0.25 to 0.78 mm) which has been found satisfactory for purposes of the subject invention when surfaces 65 and 66 have diameters in the order of 2.2 to 2.5 inches (56 to 63.5 mm).

SECOND EMBODIMENT

Figure 2:
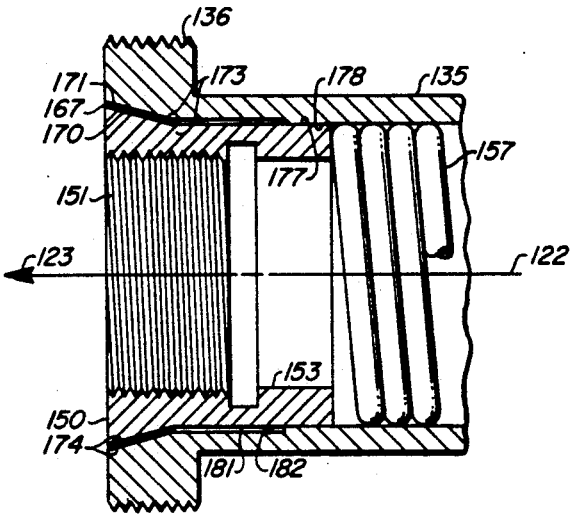
FIG. 2 is an axial section showing a second embodiment of the invention.

A second embodiment of the subject invention is shown in FIG. 2 in which only those elements, of a device corresponding to device 10, differing from the elements shown in FIG. 1 are depicted together with a predetermined axis 122 and direction 123 therealong corresponding to axis 22 and direction 23. The embodiment of FIG. 2 has an outer sleeve 135 having screw threads 136, has an inner sleeve 150 having screw threads 151 and a cylindrical surface 153, has a spring 157, and has a layer 167 which connects sleeves 135 and 150 and is, preferably, formed of soft solder. These elements correspond in structure and arrangement, respectively, to elements 35, 36, 50, 51, 53, 57, and 67 shown in FIG. 1 and are depicted without ordnance item elements corresponding to casing 13 and fuze 14. It is evident that an outer sleeve 35 or 135, which is connected to an inner sleeve 50 or 150 by a layer 67 or 167 and assembled with a spring 57 or 157, can be stored in assembled relation to an existing ordnance item and an existing fuze, such as 14, installed shortly before deployment of the item.

The areas at which the embodiment of FIG. 2 differs from that of FIG. 1 will now be described. Inner sleeve 150 bears a first or inner retaining surface 170, which is frusto-conical, and outer sleeve 135 bears a second or outer retaining surface 171 conforming to and circumscribing surface 170. Surfaces 170 and 171 are disposed in juxtapositioned relation and are aligned with screw threads 136 and 151 transversely of axis 122. It is evident that surface 170 is disposed exteriorly of sleeve 150 and surface 171 is disposed centrally of sleeve 135 and that movement of the inner sleeve in direction 123 separates surfaces 170 and 171 when such movement begins. Surfaces 170 and 171 have individual smaller diameter ends 173 and have individual larger diameter ends 174 disposed in direction 123 therefrom.

Inner sleeve 150 bears a cylindrical alignment surface 177 and outer sleeve 135 bears an alignment surface 178 conforming to surface 177. Surfaces 177 and 178 are coaxially related along axis 122 and are disposed radially in facing and relatively closely spaced slideable relation to facilitate coaxial alignment of sleeves 135 and 150 before the formation of layer 167. Surfaces 177 and 178 are disposed at the end of sleeve 135 opposite surfaces 170 and 171 and are thus spaced from smaller diameter ends 173 oppositely of larger diameter ends 174 in a direction along axis 122 opposite direction 123. Inner sleeve 150 bears a cylindrical surface portion or spacing surface 181 extending between alignment surface 177 and the corresponding end 173. Surfaces 177 and 181, typically, have the same diameter and provide a continuous area of sleeve 150. Outer sleeve 135 bears a cylindrical surface portion or spacing surface 182 extending between alignment surface 178 and the corresponding smaller diameter end 173 and disposed in facing relation to surface 181.

Surface 182 has a larger diameter than surface 181 such that these surfaces are spaced radially a substantially greater distance than retaining surfaces 170 and 171 and alignment surfaces 177 and 178 are spaced. As a result, when soft solder in a flowable state exists between surfaces 170 and 171, solder escaping from between these surfaces onto surface 181 or onto surface 182 does not engage the other one of the latter surfaces and connect sleeves 135 and 150 thereat when the solder hardens. It has been found that, in a device embodying the subject invention and having surfaces corresponding to surfaces 170, 171, 177, 178, 181, and 182 with a diameter in the order of 2.2 inch (56 mm), a radial spacing in the order of 0.005 inch (0.125 mm) between surfaces corresponding to surfaces 170, 171, 177, and 178 and a radial spacing in the order of 0.05 inch (1.25 mm) between surfaces corresponding to surfaces 181 and 182 provides convenient assembly and effective operation of the device.

It will be apparent to one skilled in the art that sleeves 35 and 50 of the embodiment shown in FIG. 1 can be provided with radially spaced surface portions corresponding to surfaces 181 and 182 of the embodiment shown in FIG. 2 by increasing the diameter of surface 40 or decreasing the diameter of surface 60 only in a region adjacent to counterbore 43 so that flowable material used to form a layer corresponding to layer 67 and interconnecting the sleeves at the counterbore does not connect the sleeves at such spaced surface portions and so that the remaining and more closely radially spaced portions of surfaces 40 and 66 facilitate coaxial alignment of sleeves 35 and 50.

Obviously many modifications and variations of the subject invention are possible in light of the above teachings. It is, therefore, to be understood that the invention may be practiced within the scope of the following claims other than as specifically described herein.

What is claimed is:

1. A thermosensitive pop-out device for use in an ordnance item having a casing, an opening defined by the casing, a charge which is subject to cook-off within the casing, and a fuze extended centrally of the opening for desired initiation of the charge, the device comprising:

an inner sleeve configured to circumscribe the fuze and bearing a first retaining surface;

means for fixedly connecting the inner sleeve and the fuze;

an outer sleeve circumscribing the inner sleeve and configured for reception in said opening, the outer sleeve being slideably related to the inner sleeve for movement of the inner sleeve together with a fuze fixed thereto in a path from the casing, and the outer sleeve bearing a second retaining surface conforming to the first retaining surface, the second retaining surface being disposed for juxtapositioned relation to the first retaining surface when a fuze fixed to the inner sleeve is disposed to initiate the charge and being disposed for separation from the first retaining surface when the inner sleeve begins such movement;

means for fixedly connecting the outer sleeve and the casing;

a pair of conforming alignment surfaces borne individually by the sleeves and spaced from the retaining surfaces in a direction along said path;

motivating means for urging the inner sleeve along said path;

means disposed in a layer between said retaining surfaces for retaining the inner sleeve to the outer sleeve against said urging at predetermined normal temperature and for releasing the inner sleeve from the outer sleeve at a predetermined higher temperature so that the inner sleeve is moved along said path by the motivating means to carry a fuze fixed to the inner sleeve from the charge to avoid cook-off thereof, said means disposed in a layer being in a flowable state when initially disposed therein; and each sleeve having a surface portion extending between the retaining surface and the alignment surface of said sleeve and facing said surface portion of the other sleeve, said surface portions of the sleeves being disposed in a spaced relation transversely of said path so that said material in said flowable state which flows from between the retaining surfaces onto said surface portion does not retain the sleeves together thereat.

2. The device of claim 1 wherein the retaining surface are frusto-conical.

3. The device of claim 1 wherein said means disposed in a layer is soft solder.

4. The device of claim 1 wherein the first retaining surface, the second retaining surface, and said means connecting the outer sleeve and the casing are aligned in a direction transversely of said path and are adjacent to the exterior of said casing to facilitate heat transfer from said exterior to said layer between the retaining surfaces.

5. In a thermosensitive pop-out device for expelling a fuze from an ordnance item to prevent cook-off of a charge thereof in which the device includes:

a generally cylindrical outer sleeve having a predetermined axis and an axially open end portion and having means peripherally thereof for fixedly connecting the outer sleeve to a casing of said item;

a generally cylindrical inner sleeve substantially coaxially received within the outer sleeve for movement axially thereof toward said open end, the inner sleeve being configured to receive such a fuze centrally therein and having means for fixedly connecting the fuze thereto;

expelling means extending from the inner sleeve oppositely of said open end portion for resiliently urging the inner sleeve and such a fuze connected therein to move from the outer sleeve in a predetermined direction along said predetermined axis and through said open end portion;

an outer retaining surface circumscribed by the outer sleeve and borne thereby centrally of said end portion;

an inner retaining surface borne by and circumscribing the inner sleeve, said inner surface conforming to and being juxtapositioned to said outer surface; and means disposed in a layer extending between said retaining surfaces for connecting said sleeves thereat to retain the inner sleeve in the outer sleeve against the urging of said expelling means at predetermined normal temperatures and for disconnecting said surfaces at a predetermined higher temperature so that said expelling means motivates the inner sleeve from the outer sleeve, said means disposed in a layer being a material which is relatively rigid at said normal temperatures so as to connect the retaining surfaces and which becomes relatively softened at increasing temperature, so as to disconnect the retaining surfaces and said material being in a flowable state when initially disposed between the retaining surfaces, The improvement comprising:

said retaining surfaces being frusto-conical, each retaining surface having a smaller diameter end and having a larger diameter end disposed in said predetermined direction therefrom;

a pair of cylindrical alignment surfaces borne individually by said sleeves, said alignment surfaces being coaxially related along said predetermined axis and spaced therealong from said smaller diameter ends oppositely of said larger diameter ends and being disposed radially in facing and relatively closely spaced relation to facilitate coaxial alignment of the sleeves; and a pair of generally cylindrical spacing surfaces borne individually by said sleeves and extending between the corresponding smaller diameter end and the corresponding alignment surface, said spacing surfaces being disposed in in facing relation radially of said predetermined axis and being spaced a substantially greater distance than the retaining surfaces and the alignment surfaces, whereby said material in a flowable state escaping from between the retaining surfaces onto one of the spacing surfaces does not connect the sleeves thereat.

6. The device of claim 5 wherein said material is soft solder.

* * * * *